US005216827A

United States Patent [19]

Cohen

[11] Patent Number: 5,216,827

[45] Date of Patent: Jun. 8, 1993

[54] SOCCER TRAINING SHOE

[76] Inventor: Yoav Cohen, P.O. Box 4077, Woodbridge, Conn. 06525

[21] Appl. No.: 894,266

[22] Filed: Jun. 8, 1992

Related U.S. Application Data

[63] Continuation of Ser. No. 612,967, Nov. 15, 1990, abandoned, which is a continuation-in-part of Ser. No. 444,368, Dec. 1, 1989, Pat. No. Des. 324,938.

[51] Int. Cl.[5] ..... A43B 5/00

[52] U.S. Cl. ..... 36/134; 36/114; 36/133

[58] Field of Search ..... 36/136, 132, 128, 114, 36/100, 101, 133

[56] References Cited

U.S. PATENT DOCUMENTS

D. 324,938 3/1992 Cohen ..... D2/311
2,503,586 4/1950 Miller .
3,348,842 10/1967 Stern .
4,204,346 5/1980 Fugere ..... 36/133
4,422,249 12/1983 Hannah ..... 36/133
4,711,043 12/1987 Johnson et al. ..... 36/139
4,712,317 12/1987 Sowell ..... 36/133

*Primary Examiner*—David T. Fidei
*Assistant Examiner*—M. D. Patterson
*Attorney, Agent, or Firm*—Evelyn M. Sommer

[57] ABSTRACT

A soccer training shoe has a multiplicity of target sectors affixed over different shoe portions which have a different shape corresponding to an optimal area of kicking contact for a respective kicking technique and a different color from the other target sectors to allow one to visually distinguish what type of kicking technique has been performed and whether it has been performed optimally. In the preferred embodiment, the soccer training shoe has target sectors on the heel, forward instep, middle instep, lace, outside foot, and toe portions of the shoe.

2 Claims, 3 Drawing Sheets

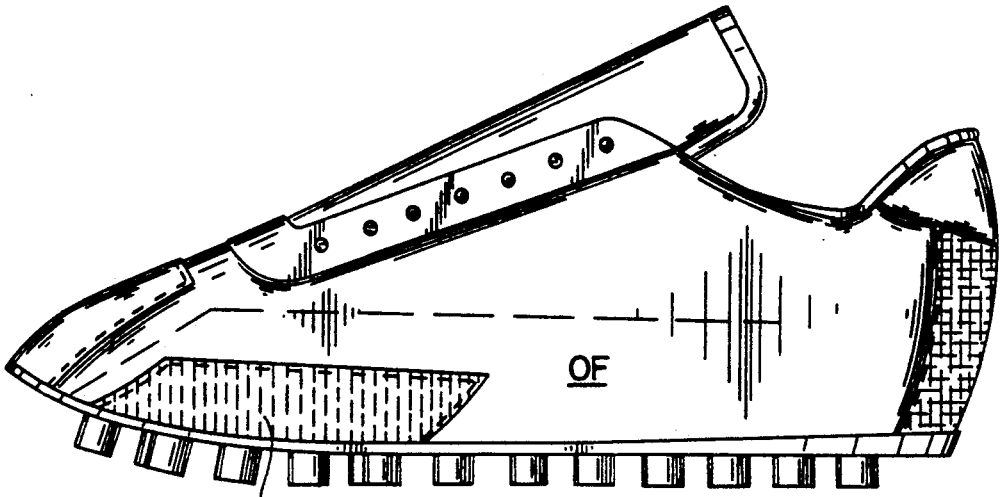
FIG.4
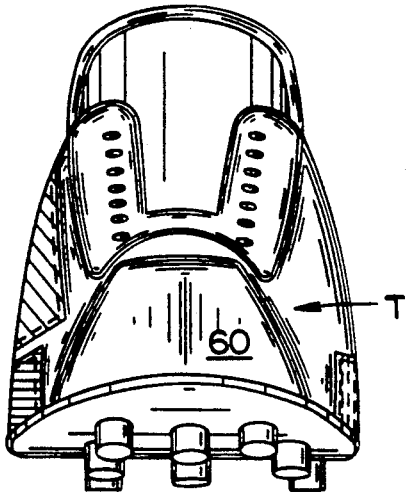
FIG.5
FIG.6A
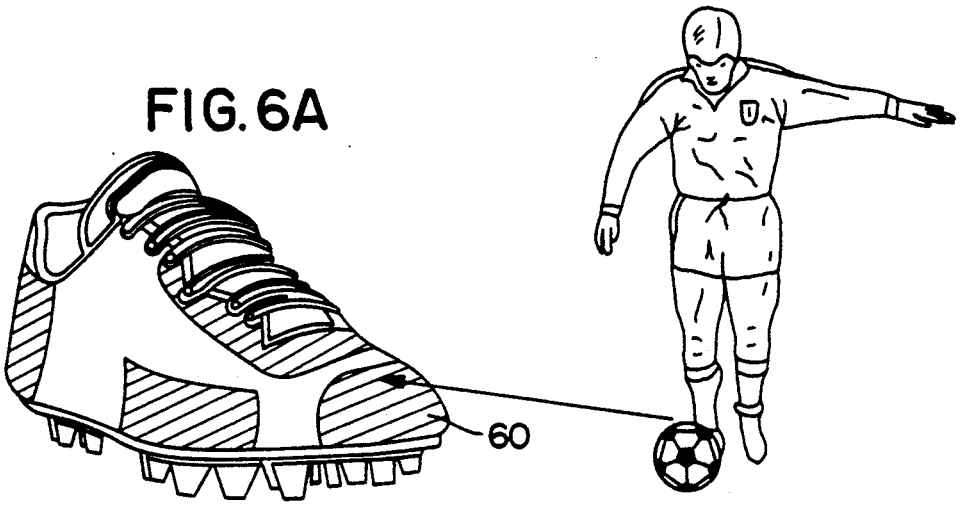

SOCCER TRAINING SHOE

This application is a continuation of U.S. patent application Ser. No. 07/612,967 of the same inventor, filed on Nov. 15, 1990, which is a continuation-in-part of U.S. patent application No. 07/444,368 now U.S. Pat. No. D 324,938 of the same inventor, filed on Dec. 1, 1989, and entitled "Soccer Training Shoe", now abandoned.

FIELD OF THE INVENTION

This invention generally relates to a design for a training shoe, and more particularly, to one suitable as a soccer training shoe.

BACKGROUND ART

It is well known in the art to provide athletic and sports shoes with padding or impact layers on parts thereof to render the strength and other performance characteristics of such shoes suitable for particular sports. For example, in U.S. Pat. No. 4,204,346 to Fugere, a training shoe for soccer is stitched with a toe portion and an instep portion of a different, visually distinctive color (e.g., red) from the rest of the shoe as a training aid for proper kicking techniques for soccer. However, the Fugere training shoe has relatively low utility as a training aid because the kicking portions of the shoe cover quite broad areas and do not distinguish between different types of soccer kicks which may be performed even from the same kicking portion.

SUMMARY OF THE INVENTION

Accordingly, it is a principal object of the invention to provide a training shoe, particularly for soccer, which has a high utility for differentiating between a large number of different types of kicking techniques. It is a further object that such a training shoe be configured to allow one to distinguish readily what type of kick has been performed and whether it has been performed optimally.

In accordance with the present invention, a training shoe comprises heel, outside foot, toe, instep, and lace portions, and a multiplicity of target sectors affixed over respective ones of said shoe portions, wherein each one of said target sectors has a different shape corresponding to an optimal area of kicking contact for a respective type of kicking technique and a different color from the other target sectors in order to allow one to visually distinguish what type of kicking technique has been performed and whether it has been performed optimally.

In the preferred embodiment, the target sectors each have a distinctive geometric shape corresponding to the optimal kicking area that each target sector represents, and has a bright, distinctive color that allows the player or the coach to readily determine whether a particular type of kick has been optimally performed on the target sector. The preferred soccer training shoe has a heel target sector for a heel kick, a forward instep target sector for a lofted pass, a middle instep target sector for a push pass, a lace target sector for a low driven pass, volley shot, or dribbling, an outside target sector for a bent pass or dribbling, and a toe target sector for a chip shot or toe pass.

Other objects, features, and advantages of the present invention will become apparent from the following detailed description of the best mode of practising the invention when considered in conjunction with the drawings, as follows:

DESCRIPTION OF THE DRAWINGS

FIG. 4 is a side view showing the outside foot portion of the soccer training shoe;

FIG. 5 is a front view showing the toe portion of the soccer training shoe; and FIGS. 6A–6E are views illustrating the use of the different target sectors of the soccer training shoe for training.

DESCRIPTION OF THE PREFERRED EMBODIMENTS

Figure 3:
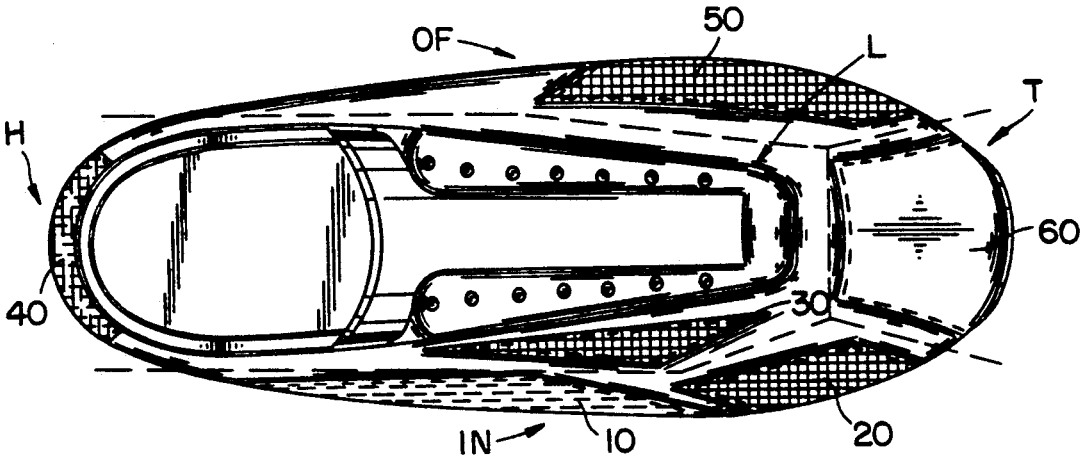
FIG. 3 is a plan view showing the portions of the soccer training shoe together.

Referring first to FIG. 3, a shoe is shown comprised of the following well-known portions: heel portion H; outside foot portion OF; instep portion IN; lace portion L; and toe portion T. Although there is no precise demarcation of these portions, it is understood in the shoe industry and by the public generally that these portions are capable of general description for most types of shoes.

According to the present invention, a multiplicity of target sectors are affixed over respective ones of the abovedescribed shoe portions. Each target sector has a different shape corresponding to an optimal area of kicking contact for a respective type of kicking technique, and a different color from the other target sectors in order to allow one to visually distinguish what type of kicking technique has been performed and whether it has been performed optimally.

Figure 1:
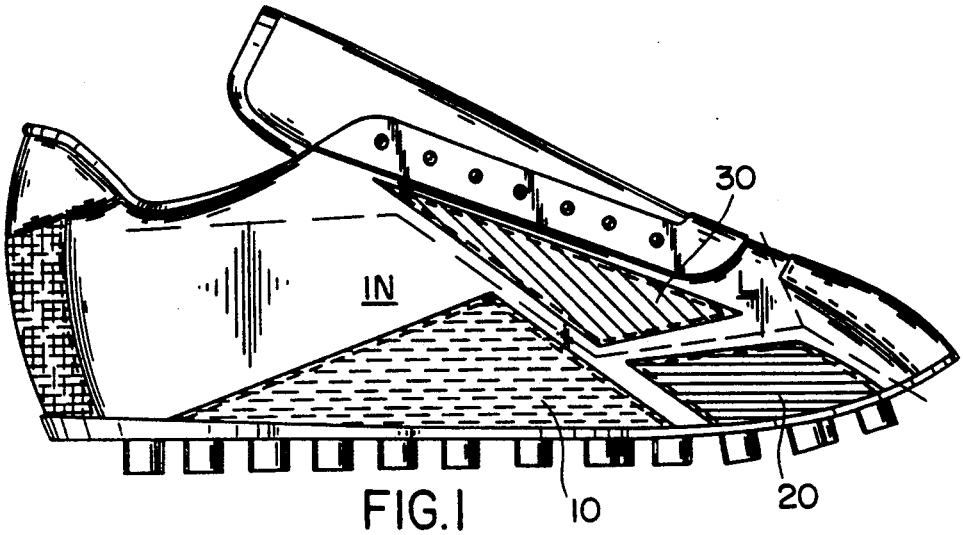
FIG. 1 is a side view showing the instep portion of a soccer training shoe in accordance with the invention.
Figure 2:
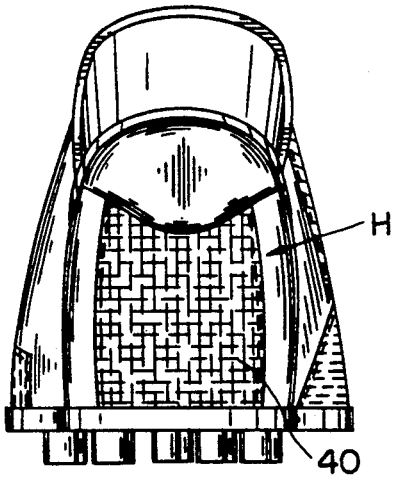
FIG. 2 is a rear view showing the heel portion of the soccer training shoe.

In FIG. 1, the instep portion IN of the shoe has a middle instep target sector 10 and a forward instep target sector 20. The lace portion L of the shoe has a lace target sector 30 on the inside of the foot, or may have such, a target sector on both sides of the foot. In FIG. 2, the heel portion H has a heel target sector 40. In FIG. 4, an outside target sector 50 is shown in the outside foot portion of the shoe. In FIG. 5, a toe target sector 60 is fixed on the toe portion of the shoe.

Figure 6B:
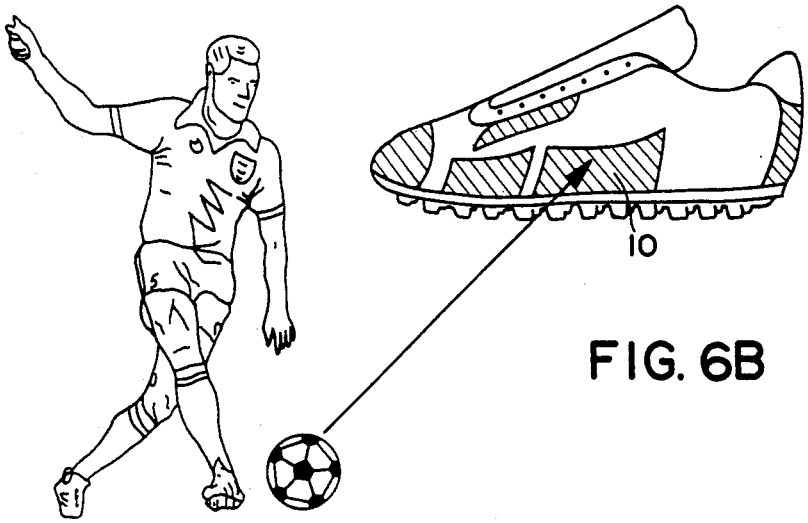
Figure 6C:
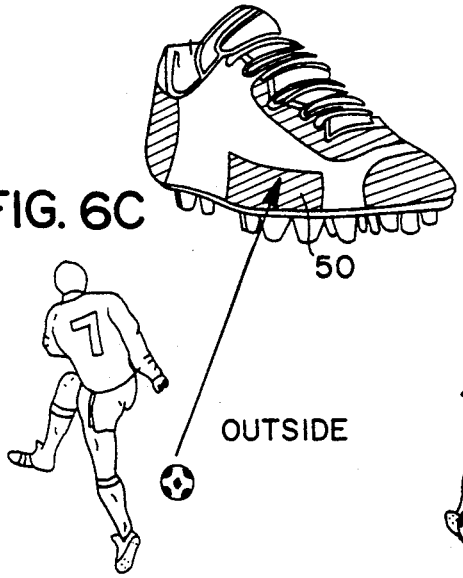
Figure 6D:
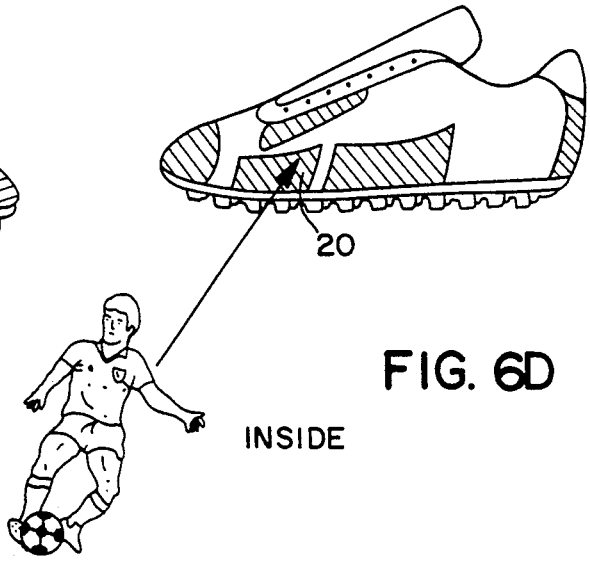
Figure 6E:
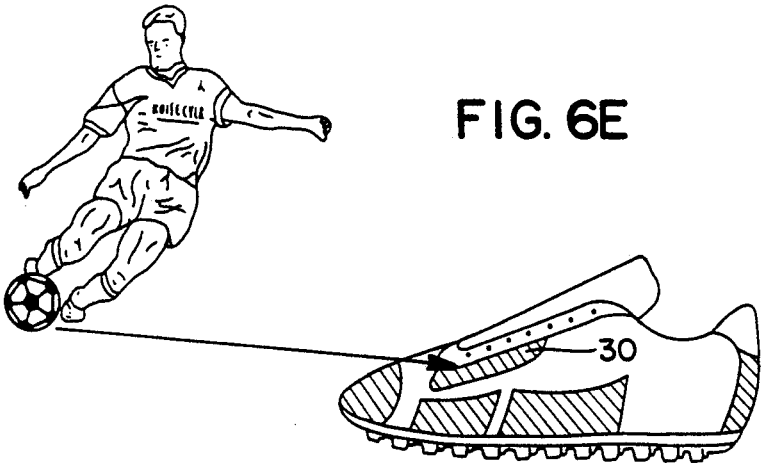

The preferred embodiment has at least five target sectors, each having its own unique geometric shape and color, allows a player or coach to monitor different types of well-known kicking techniques for soccer which correspond to the target sectors. For example, in FIG. 6B, the middle instep target sector 10 is designed for a push pass, shots from close range, and for cushion and wedge control of the ball using the foot. In FIG. 6D, the forward instep sector 20 is designed for the bent pass or shot, the lofted pass or shot, and for dribbling. In FIG. 6E, the lace target sector 30 is designed for a low driven pass or shot, a side, half, or full volley, for cushion control, and dribbling. The heel target sector 40 is suited for the heel pass and dribbling. In FIG. 6C, the outside target sector 50 is suited for the bent pass or shot, for wedge control, and dribbling. Finally, the toe target sector 60 in FIG. 6A is shaped and situated for optimal performance of a toe poke pass, a chip pass, or a chip shot.

The geometry and location of the respective target sectors are designed to provide the optimal training aid for kicking the ball with that area of the shoe. The shapes and colors of the target sectors are designed to help the player visualize where the foot and the ball should meet. In the preferred embodiment, the target sectors are all of different colors, i.e., grey, aqua, blue, purple, and yellow, and placed on the neutral background, i.e., black or white, of the shoe.

From the foregoing description, it will be recognized that the present invention provides a soccer training shoe of enhanced utility in training for kicking performance. The different locations, shapes, and colors of the multiplicity of target sectors ensures that a wide range of kicking types or technique can be visually monitored and practiced with ease. The visual distinctiveness of the different target sectors facilitates the training of the wearer to make rapid improvement, as well as allows a coach to make quick visual assessments when viewing the actions of a team of players in a practice or game. The principles of the invention may of course be applied readily to other sports such as football, boxing, and various forms of full contact martial arts.

Numerous modifications and variations are of course possible in light of the principles of the invention disclosed above. For example, All such modifications and variations are intended to be included within the spirit and scope of the invention, as defined in the following claims.

I claim:

1. A training shoe adapted for soccer comprising:

a shoe body having heel, outside foot, toe, instep, and lace portions; and at least six target sectors affixed over respective shoe portions, as follows:

(a) a heel target sector affixed to the heel portion of the training shoe having a shape and being positioned on the shoe for training of a heel kick by contact of a ball with said heel target sector;

(b) a forward instep target sector affixed to a forward part of the instep portion of the training shoe having a shape and being positioned on the shoe for training of a lofted pass or shot by contact of a ball with said forward instep target sector;

(c) a middle instep target sector affixed to an intermediate part of the instep portion of the training shoe spaced apart and separate from said forward instep target sector and having a shape and being positioned on the shoe for training of a push pass or shot from close range by contact of a ball with said middle instep target sector;

(d) an outside target sector affixed on the outside foot portion of the training shoe having a shape and being positioned on the shoe for training of a bent pass and dribbling by contact of a ball with said outside target sector;

(e) a lace target sector affixed adjacent the lace portion on at least one side of the training shoe spaced apart and separate from said forward and middle instep and outside target sectors and having a shape and being positioned on the shoe for training of a low driven pass, volley shot, and dribbling by contact of a ball with said lace target sector; and (f) a toe target sector affixed on the toe portion of the training shoe spaced apart and separate from said forward and middle instep, outside, and lace target sectors and having a shape and being positioned on the shoe for training of a chip pass or toe shot by contact of a ball with said toe target sector.

2. A training shoe according to claim 1, wherein each of said target sectors has a different shape corresponding to an optimal area of kicking contact for a respective type of kicking technique and a different color from the other target sectors in order to allow one to visually distinguish what type of kicking technique has been performed and whether it has been performed optimally with said training shoe.

* * * * *